US005996311A

United States Patent [19]

Heard et al.

[11] Patent Number: 5,996,311

[45] Date of Patent: Dec. 7, 1999

[54] DEVICE FOR TIGHTENING CAPS ON CONTAINERS

[75] Inventors: Bruce L Heard, New Berlin; Mark G Larson, Oak Creek, both of Wis.

[73] Assignee: Krones, Inc., Franklin, Wis.

[21] Appl. No.: 09/131,576

[22] Filed: Aug. 10, 1998

[51] Int. Cl.[6] ..... B65B 3/20; B65B 7/28

[52] U.S. Cl. ..... 53/317; 53/331.5

[58] Field of Search ..... 53/314, 315, 317, 53/306, 331.5

[56] References Cited

U.S. PATENT DOCUMENTS

| | | | |
|---|---|---|---|
| 3,184,897 | 5/1965 | Shriner | 53/331.5 |
| 4,178,732 | 12/1979 | Pfleger | 53/331.5 |
| 4,485,609 | 12/1984 | Kowal . | |
| 4,492,068 | 1/1985 | Obrist . | |
| 4,674,264 | 6/1987 | Ellis et al. . | |
| 5,284,001 | 2/1994 | Ocha | 53/331.5 |
| 5,313,765 | 5/1994 | Martin . | |
| 5,490,369 | 2/1996 | Ellis et al. | 53/317 |

*Primary Examiner*—John Sipos
*Attorney, Agent, or Firm*—Ryan Kromholz & Manion

[57] ABSTRACT

A plurality of containers on which untightened threaded caps are deposited are transported in a circular path synchronously with a cap tightening device for each container. The devices have a substantial vertical reciprocable non-rotatable shaft on which a cylindrical member is rotatable and a cylindrical housing is mounted to and is axially adjustable on the member. A spool of magnetic metal is rotatable on the shaft and is adapted for engaging a cap to turn and tighten it. Magnetizable and magnetized elements are arranged with the housing concentrically to the spool. While being transported the housings of the devices engage a stationary driver which turns the housings consecutively so the spools turn by virtue of magnetic coupling between the magnetic elements and the spool.

12 Claims, 5 Drawing Sheets

FIG. 3
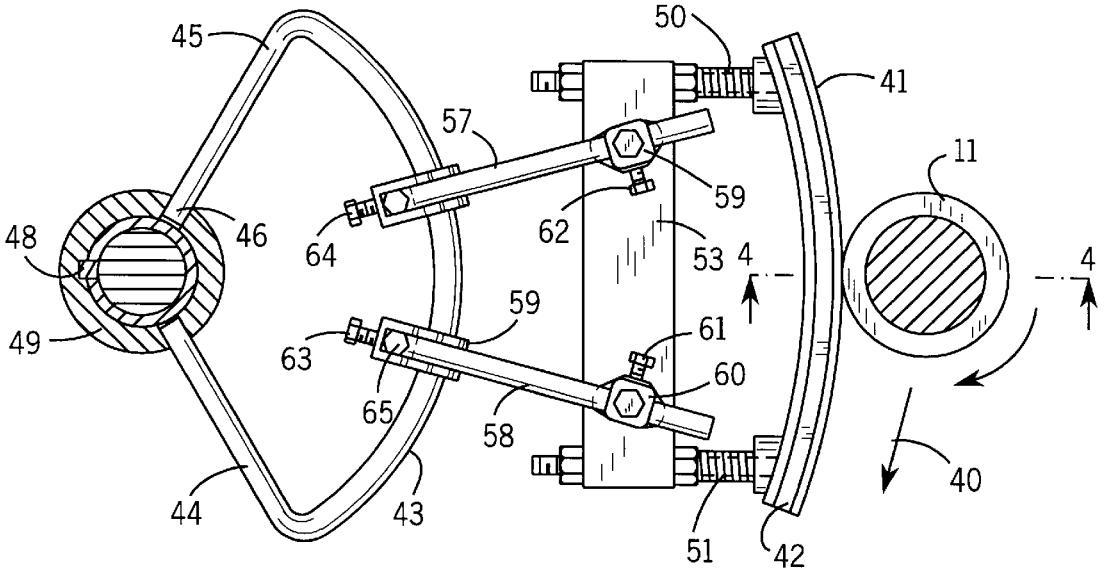
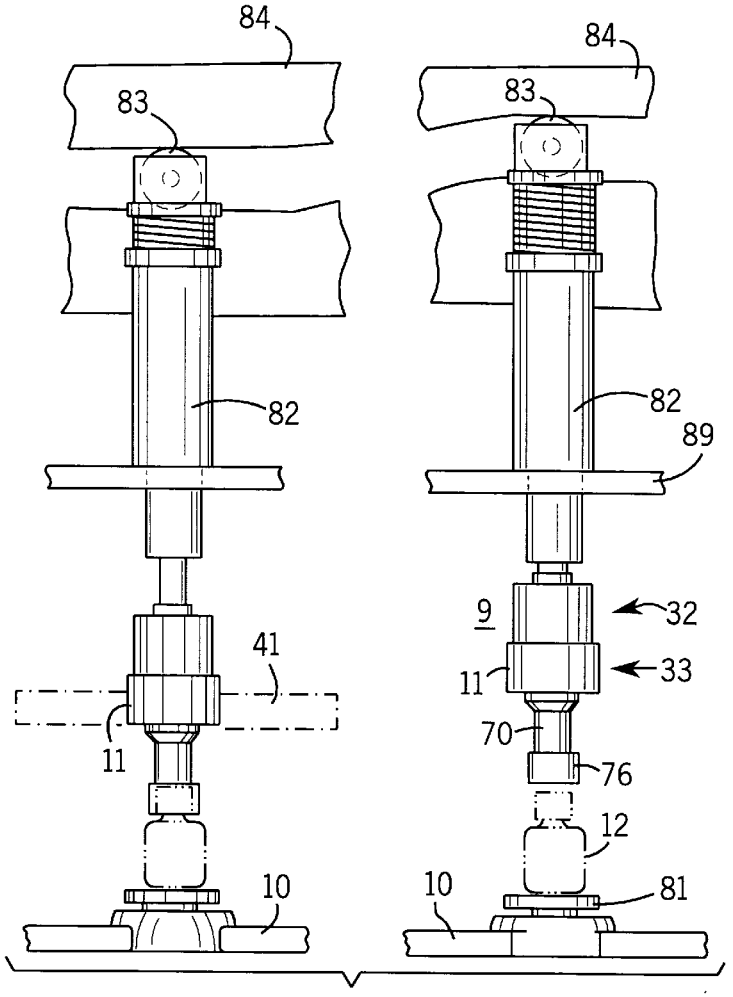
FIG. 7

FIG. 8
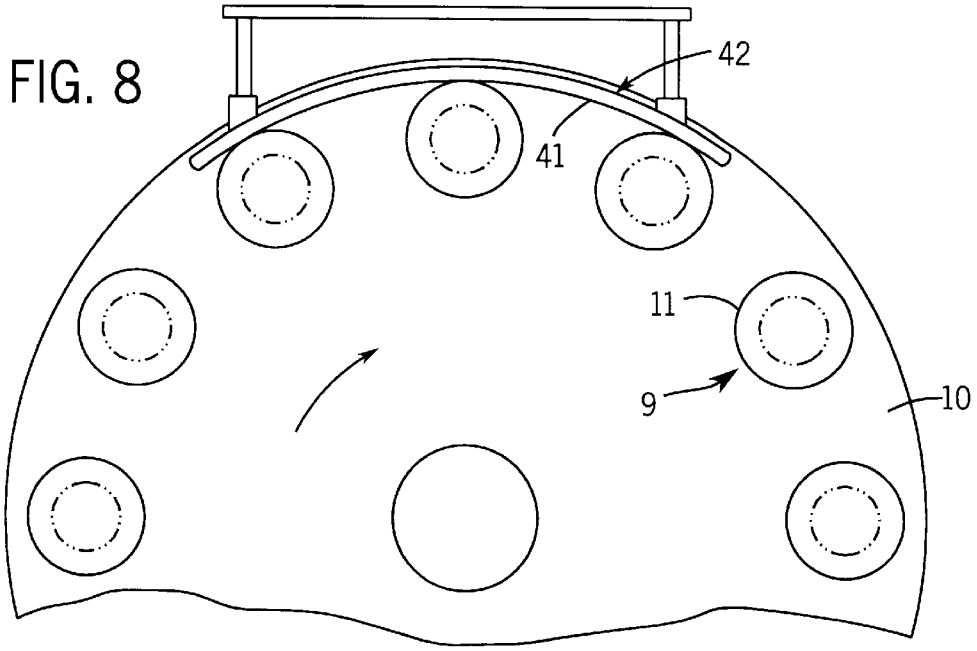
FIG. 10
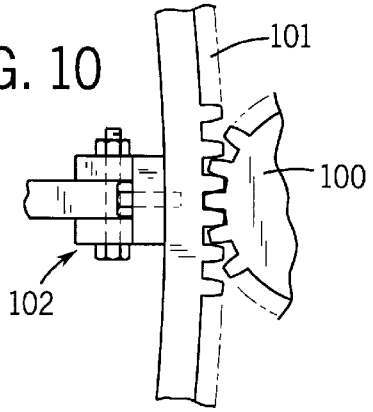
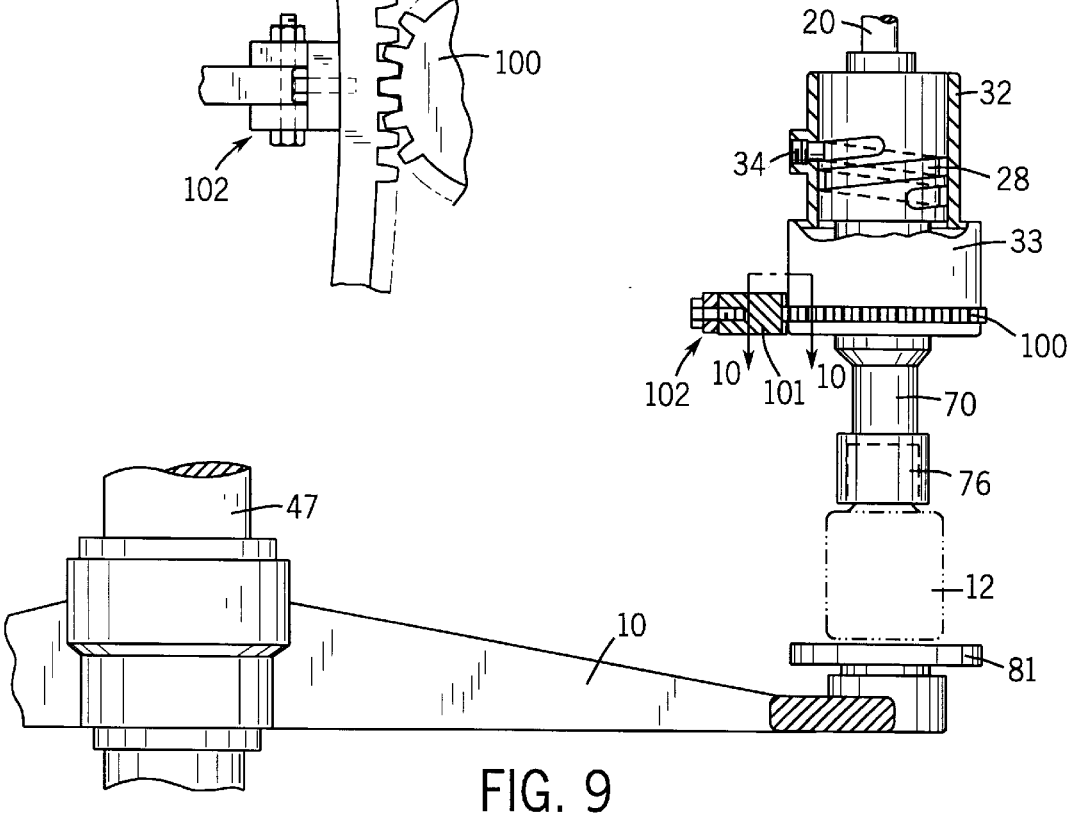
FIG. 9

DEVICE FOR TIGHTENING CAPS ON CONTAINERS

BACKGROUND OF THE INVENTION

The invention disclosed herein pertains to a device for turning threaded caps onto the threaded necks of containers with a controlled maximum torsional force.

Capping devices for applying threaded caps on the necks of prethreaded containers are generally well known. To assure that the threaded cap is not applied too tightly to the container, most advanced capping devices incorporate a magnetic clutch comprised of a hysteresis ring composed of low magnetic reluctance material, such as that known by the trademark Hysterloy, fastened to a rotationally driven part and a plurality of permanent magnets disposed within a circle within the ring and magnetically coupled to a member that engages with the cap such that when a certain torsional force is reached the hysteresis ring slips relative to the magnets to thereby limit the transmitted torsional force that is applied to the cap. A hysteresis clutch is disclosed in U.S. Pat. No. 4,485,609, for example.

In some production lines using prior art capping devices, containers with caps loosely applied are loaded onto a conveyor, such as a rotating turntable or linear conveyor, for being transported while the cap of the container is engaged by a cap tightener device which moves synchronously with the container. Typically, the device is mounted to a shaft which is driven rotationally for imparting a torsional force to the device for it to tighten the cap. A disadvantage of this arrangement is that every cap tightener device is mounted on a shaft which must be driven rotationally for the cap tightener to turn the cap and besides a camming mechanism is required for lowering and raising the rotating shaft and the device to grip the cap and to withdraw it from the cap. This results in an unduly complicated and expensive capping machine.

SUMMARY OF THE INVENTION

According to the invention, containers whose caps are to be tightened are deposited on the support plates of a conveyor, preferably a turntable-type conveyor. At this time, the caps may have been simply deposited on the threaded necks of the containers or they may have been previously tightened and have loosened so they require retorquing. Immediately upon arrival on the conveyor, the cap and the bottle on which the cap is deposited is engaged by one of the descending new cap tightening devices for the purpose of stabilizing the container as it proceeds along an orbital path on the conveyor or turntable. Supports for the containers on the turntable are arranged in a circle so the containers orbit in a circular path.

In a first embodiment of the invention the containers orbit while being engaged and stabilized by the new capping devices until they arrive in succession at a curved stationary friction drive member. The plurality of cap tightening devices orbit over the plates on which the containers are supported on the turntable and the capping devices are respectively maintained in fixed relationship with an individual container support. The stationary friction member is mounted in a position which requires all of the capping devices to come in contact with it while they are engaged with a container cap. The moving cap tightener devices have a friction susceptible external cylindrical surface which engages the stationary friction imparting surface of the member to cause rotation of the cylindrical body of the device that is indirectly coupled to the cap gripping adapter such that the cap is screwed more tightly onto the threaded neck of the container. The cap tightener device is provided with a magnetic clutch that releases the torsional driving force when the cap has attained a specified degree of tightness.

In the first embodiment of the invention outlined above the capping device is driven rotationally by way of the cylindrical housing of the device contacting and rolling along the curved stationary friction surface as the devices orbit along with the respective containers.

In the second embodiment, in place of the friction surface, a toothed gear segment is positioned adjacent the orbital path of the containers that are orbiting with the capping devices and the containers as the turntable turns. The cylindrical housings of the capping devices have a ring gear fastened to or machined on them. The ring gears are concentric to the respective non-rotating shafts on which the capping devices are journaled for rotation so when the cap tightener devices are transported by the turntable the ring gears mesh successively with the gear segment which causes the devices to rotate and thereby tighten the caps.

Accordingly, an objective of the invention is to provide a container capping device that is simplified and reliable in its construction and is integrated with the capping machine as a whole in such manner as to allow simplification of the entire machine.

A more specific objective of the invention is to provide a capping device that eliminates the need for the shafts on which the devices are mounted to be rotated to perform a cap tightening operation but, instead the shaft needs only to be reciprocated downwardly and upwardly to execute a cap tightening cycle and it is the device that is driven rotationally to tighten a cap.

How the foregoing objectives and other more specific objectives and features of the invention are achieved and implemented will appear in the ensuing more detailed description of a preferred embodiment of the invention which will now be set forth in reference to the accompanying drawings.

DESCRIPTION OF THE DRAWINGS

FIG. 3 is a top plan view of the curved device that has a frictional surface for engaging the orbiting capping devices at an appropriate time to turn the cap tightly onto the container, said FIGURE also showing the support mechanism for adjusting the position of the frictional surface;

FIG. 7 shows how a camming arrangement is provided for lowering the cap tightening device into engagement with a cap for being driven rotationally after which the device is elevated to permit the capped container to be discharged from the conveyor;

FIG. 8 is a variant of the FIG. 1 arrangement wherein the stationary friction member that drives the cap tightening devices rotationally is concave, as opposed to the convex friction surface arrangement in FIG. 1, and is positioned radially outwardly of the orbital path of the capping devices on the turntable rather than inwardly of the path;

FIG. 9 is a side elevational view of a second embodiment of the new cap tightener that is constructed basically similar to the FIGS. 1–7 embodiment but the cylindrical bodies of the new tightening devices are provided with ring gears, rather than a friction surface, that are driven rotationally as they engage in succession with a fixed gear segment to effect tightening of caps; and FIG. 10 is fragmentary view showing an orbiting gear toothed container support plate engaging a fixed gear segment for being driven rotationally thereby.

DESCRIPTION OF A PREFERRED EMBODIMENT

Figure 1:
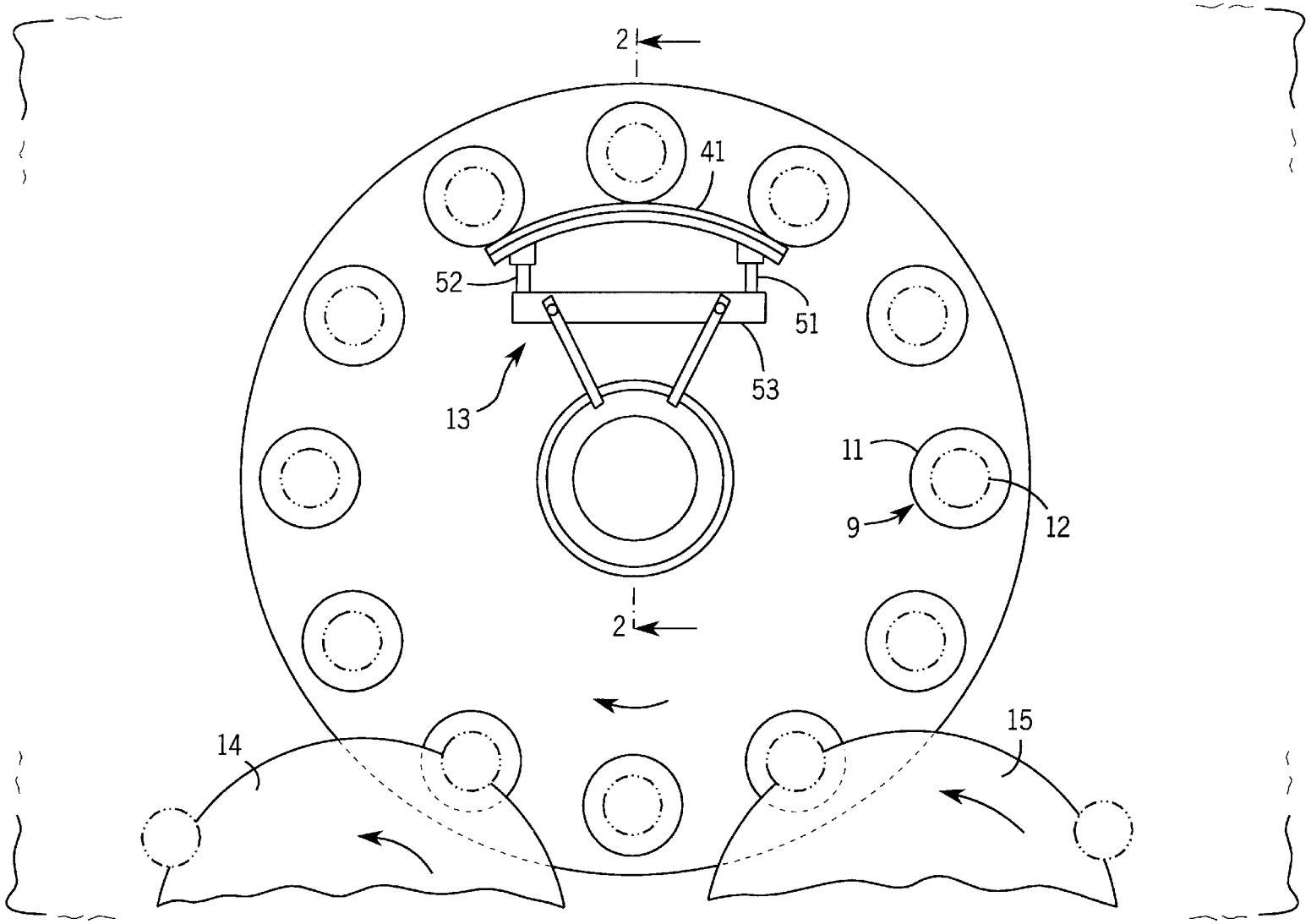
FIG. 1 is a diagram of a turntable conveyor in combination with a stationary arcuate friction imparting device which drives the new capping devices rotationally to thereby tighten caps on the containers.

FIG. 1 depicts a top plan view of a turntable 10 that is driven rotationally about a vertical axis. The circumferentially spaced apart circles 11 represent the largest outside diameter of the cap tightener devices 9 which are positioned above the turntable and orbit with the turntable 10. As will be shown later, the surface 11 of the cap tighteners is the surface, in a first embodiment of the new cap tightener, to which frictional driving force is imparted for rotating a member to effect turning a cap tightly onto a container. The smaller circles 12 that appear concentrically within the circles 11 are beneath the capping devices and represent containers that are orbiting with the turntable. The curved stationary friction surface 41 on disks together with its adjustment support is designated generally in FIG. 1 by the numeral 13 and will be described in greater particularity later in reference to FIG. 3. Containers 12, which happen to be round bottles in this example, are deposited on the turntable by means of an infeed starwheel 14 rotating in the direction of the arrow marked on it. The containers, after having caps tightened on them, are removed from the turntable with an outfeed starwheel 15. Rotationally driven bottle supports 81 (see FIG. 2) for handling round bottles can be replaced with supports that are adapted for handling rectangular or other bottle shapes are shown in U.S. patent application Ser. No. 08/735,447 filed Oct. 15, 1996, now U.S. Pat. No. 5,785,803 which is owned by the assignee of this application and is incorporated by reference.

Figure 4:
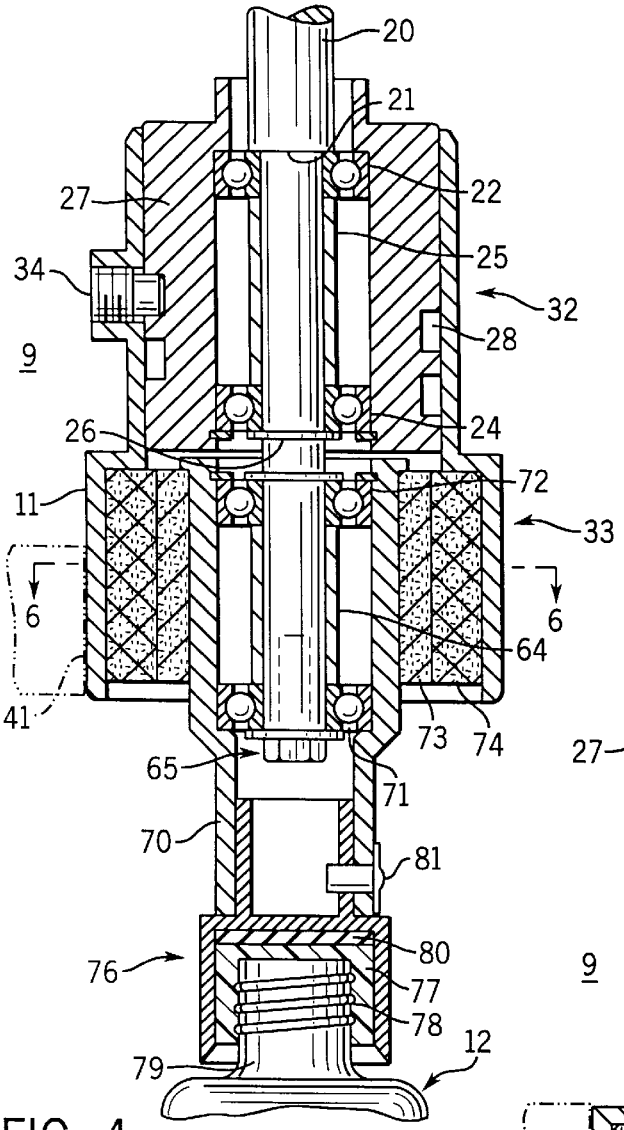
FIG. 4 is a vertical section of the capping device showing its cap adapter engaged with a cap on a fragmentarily shown container with the parts of the device adjusted for the device to impart maximum torsional force on a bottle cap.

Attention is invited to FIG. 4 for a more detailed description of the new cap tightening device 9. The device 9 comprises a shaft 20 which is not driven rotationally but moves along a circular orbital path with the turntable 10 and can be lowered and raised in connection with performing the cap tightening process using a mechanism shown in FIG. 2 which will be discussed in more detail later. In FIG. 4, non-rotating vertically reciprocable shaft 20 is seen to have a shoulder 21. A bearing 22 is fitted on the reduced diameter portion of the shaft below the shoulder. Another bearing 24 is fitted on shaft 20 and there is a spacer 25 that prevents the two bearings 22 and 24 from moving axially toward each other. The lower bearing 24 is retained against axial movement by a snap ring 26. A generally cylindrical member 27 is journaled for rotation on shaft 20 by means of bearings 22 and 24. Cylindrical member 27 has an annular helical groove 28 in its outer surface for adjustment purposes as will be elaborated later. A hollow cylindrical housing comprised of two cylindrical parts of different diameters, which are generally designated by the numerals 32 and 33 and are formed as a single piece or unit. The cylindrical surface 11 of the device housing, which was previously mentioned in connection with FIG. 1, is a surface that is engaged frictionally as the capping devices move in a circular orbit such that the housing is rotated about the axis of the shaft 20. In an actual embodiment, the cylindrical surface 11 is endowed with high frictional qualities such as by knurling.

The cylindrical member 27 turns shaft 20 is constrained against axial movement in either direction by way of the interaction between the bearings 22 and 24 and snap ring member 26. The cylindrical housing, comprised of parts 32 and 33, rotates as a unit as a consequence of being fastened to rotatable cylindrical member 27. The upper portion 32 of the housing is provided with a radially directed threaded hole that is occupied by an adjustment set screw 34 whose tip is presently registered in the helical groove 28 that surrounds member 27. When the screw 34 is screwed tightly into the threaded hole and is in strong contact with the bottom of the spiral groove 28, the housing is fixed in position relative to the upper cylindrical member 27 so that when a driving force is applied by way of friction against knurled peripheral surface of housing part 33 the upper integral portion 32 of the housing is compelled to rotate along with it and it also causes upper cylindrical member 27 to rotate about shaft 20. When the threaded set screw 34 is loosened, the housing, composed of integral cylindrical parts 32 and 33, can be rotated on cylindrical member 27 in which case the loosened set screw 34 will follow the helical groove to enable the cylindrical housing itself to be shifted or adjusted in the axial direction of the shaft 20 relative to the cylindrical member 27. When the adjustment of the housing height is appropriate for the height of the containers 12 that are to have their caps tightened, the set screw 34 is tightened to maintain the adjustment.

As alluded to earlier in reference to FIG. 1, the capping devices are driven rotationally, that is, the unitary housing parts 32 and 33 are driven rotationally jointly by means of a frictional drive apparatus depicted in FIG. 3 to which attention is now invited. Here, the large diameter peripheral surface 11 of the device housing is shown moving orbitally in the direction of the arrow 40. The periphery 11 of the part 33 of the housing of the tightener device is in frictional contact with the friction surface 41 on a rigid curved member 42. The mechanism for presenting the frictional surface 41 toward the knurled surface 11 of an orbiting cap tightening device is comprised of a curved basic support member 43. The radially extending legs 44 and 45 of support member 43 are anchored in suitable holes, such as the one marked 46 in a sleeve 47 which is fixed by way of a key 48 against rotation on a stationary shaft 49. Hence, curved support member 43 is stationary and concentric with the center of shaft 49. The member 42 having curved friction surface 41 that drives the cap tightening device rotationally is supported on studs 50 and 51 passing through a clearance hole in a cross bar 53. The cross bar is supported on rods 57 and 58. Corresponding ends of the cross bars fit into connectors 59 and 60 which provide for clamping the rods 57 and 58 by means of set screws 61 and 62. The opposite ends of the rods 57 and 58 reside in swivel connectors, such as the one marked 59 which are adapted for being slid along curved support member 43 and to be clamped in any selected position by means of set screws 63 and 64.

The structure in FIG. 3 described thus far is involved in adjusting the curved member 42 supporting the friction surface 41 so that the curvature of the frictional surface is perfectly concentric to the axis of the turntable shaft 49 in FIG. 3. The support mechanism for the friction tightener driving surface 41 is universally adjustable. That is, it can be adjusted in and out, the pitch of its curved surface can be angulated variously and it can be adjusted up and down as required to make good contact with drivable peripheral surface 11 on the cap tightening device.

Figure 2:
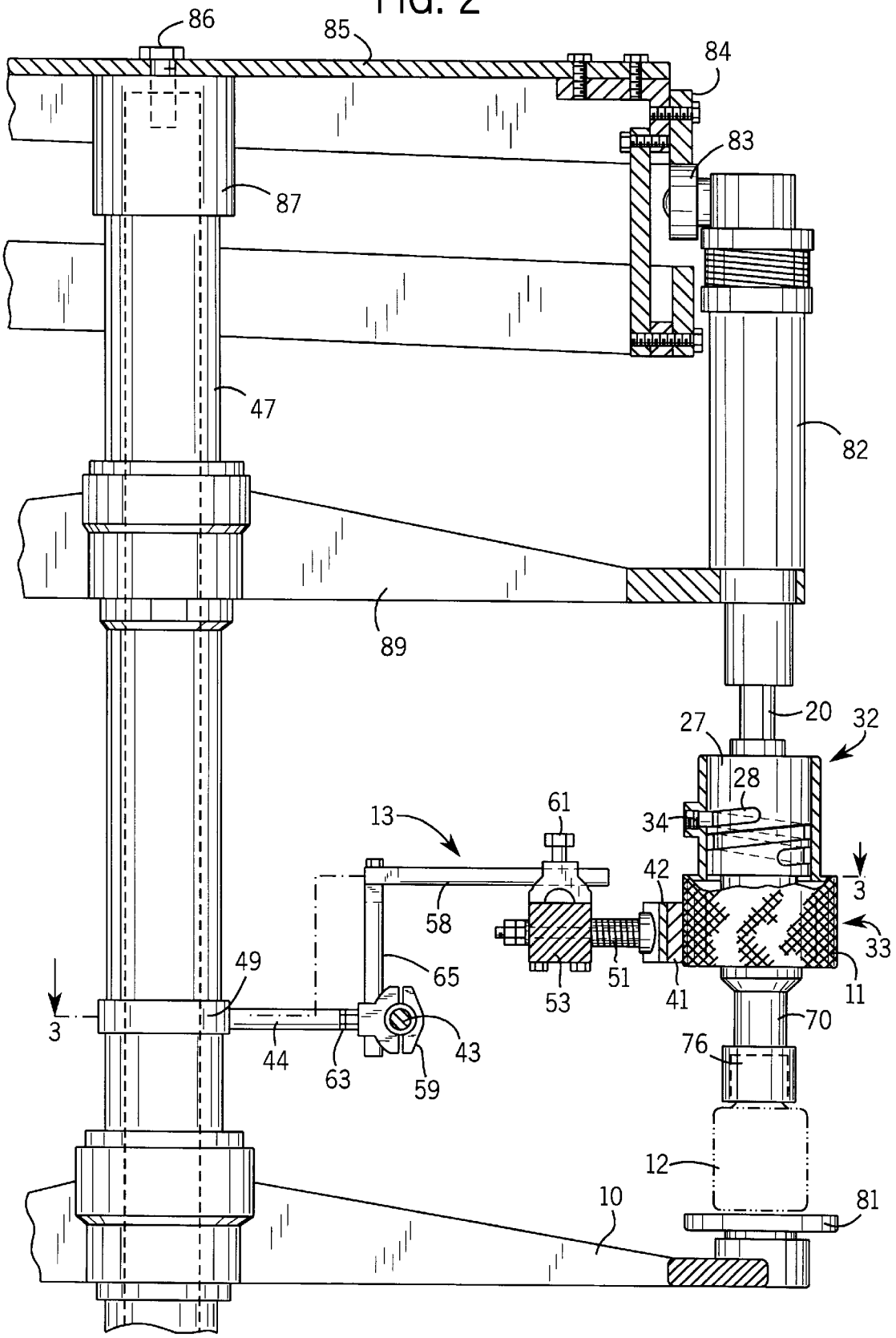
FIG. 2 depicts a symmetrical part of the turntable, a side elevational view of the capping device, a support for the actuator that raises and lowers the capping device and a cam for operating the actuator.

The up and down adjustment of the housing or body of the cap tightening device is depicted in FIG. 2 where it is evident that the typical support rod 58 connects to a vertical rod 65 that is adjustable vertically in connector 59 which is mounted to curved support member 43. In FIG. 2 the machine screws 66 with clamp swivel connector 59 and rod 58 are shown.

Figure 6:
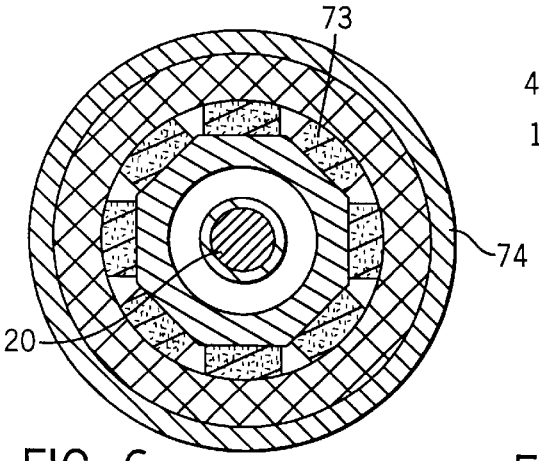
FIG. 6 is a transverse section taken on a line corresponding to the line 6—6 in FIG. 4.
Figure 5:
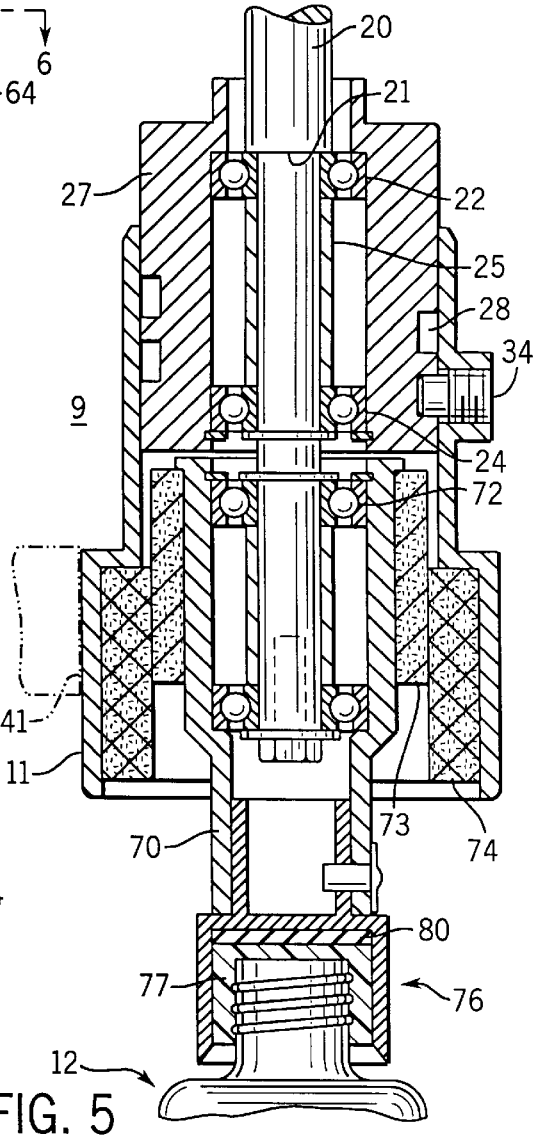
FIG. 5 illustrates how parts of the capping device may be shifted relative to each other for varying the torsional force that can be imparted to a container cap.

Attention is directed to FIGS. 4 and 5 for further description of the cap tightening device 9. FIG. 4 shows that the capping device contains a spool 70 which is concentric to shaft 20 and is journaled for rotation on the shaft by means of bearings 71 and 72. A sleeve 64 maintains the spacing between two bearings 71 and 72. A machine bolt 65 and retainer washer assembly holds the bearings in position. The spool 70 is surrounded by a plurality of permanent magnet bars 73 which are arranged in a circle as depicted in FIG. 6. The magnets are surrounded by a hysteresis ring 74 which is composed of a metal that is highly permeable to magnetic lines of force such as the material sold under the registered trademark "Hysterloy." In FIG. 4 the axial extremities of the hysteresis ring 74 and the permanent magnets 73 are coterminous at both ends. In this condition the device is set up for exerting the maximum available torsional force on caps because the magnetic attraction between the magnetized and the magnetically susceptible elements is the greatest. Here it is shown that the spool 70 can accommodate various adapters such as the one marked 76 to provide for operating on container caps 77 of various sizes and configurations. In FIG. 4 it is assumed that shaft 20 of the capping device has been cammed downwardly to its lowest position for the adapter 76 to engage the a bottle cap 74 and turn the internally threaded cap onto the externally threaded neck 78 of the bottle 12. The adapter wall is beveled at its lower end for assuring that when the adapter is moving downwardly it will cause the neck of the container to be positioned centrally in the adapter. A disk 80 composed of a somewhat pliable material lines the upper end of the adapter socket to enhance the friction between the spool driven adapter and the top of the container cap 77. Variously configured adapters 76 may be coupled to the spool by means of a removable pin 81.

In FIG. 5, the housing of the device 9 is adjusted to its lowermost position which results in the magnetic coupling force between hysteresis ring 74 and the permanent magnets 73 being minimized. The adjustment or axially directed movement of the hysteresis ring 74 relative to the magnets 73 is accomplished by loosening the detent element constituted by a threaded pin 34 which is threaded into the housing shell portion 32 so that the housing can be rotated with the pin 34 following the helical groove 28 in the periphery of the cylindrical member 27. When the housing and the hysteresis ring 74 therein are adjusted relative to the permanent magnets 73 to the point where the desired slippage will occur between the frictionally driven housing and cylindrical member 27 the screw 34 is tightened. Because in FIG. 5 the magnetic coupling is weakened between the hysteresis ring 74 and magnets 73, slippage between the ring and magnets will occur during driving of the housing when a lesser torsional force is applied to the cap 77 as compared with conditions in FIG. 4.

FIG. 2 depicts the mechanism for lowering the cap tightening device 9 for its adapter 76 to engage the cap on a container 12 that is moving in an orbital path as a result of being supported on a plate 81 that is orbiting with the turntable. The mechanism for adjustably supporting the curved friction imparting surface 41 has been described already in reference to FIG. 3. In FIG. 2 the capping device 9 is presently moving past the curved friction imparting member 41 which is acting on the knurled periphery 11 of the cylindrical capping device 9 in the cap gripping adapter 76. The number of turns imparted to the container cap will, of course, depend upon the pitch of the threads on the cap and the neck of the container as well as the circumferential length of the curved friction imparting surface 41. Of course, tightening the cap more than is specified by the adjustment of the hysteresis ring 74 relative to the magnets will not occur because the magnets and ring are fitted within the housing with such tolerances that there is adequate clearance between them to provide for slipping which prevents overtightening in any case.

In FIG. 2, one may see that the shaft 20 for the cap tightener 9 is descended so that the cap adapter 76 can grip the cap of a container 12. The shaft 20 is in a tubular housing 82 on which there is a cam follower roller 83 that cooperates with stationary cam tracks 84. The profile of the cam is such that, as mentioned earlier, it will cause shaft 20 to descend for the capping device to engage and stabilize a container cap on a bottle concurrently with the container being deposited on a container support plate 81 on the turntable 10 by the infeed star wheel 14. After any given container passes over the curved surface having frictional properties that particular container will continue in its orbital path until it reaches the outfeed starwheel 15 whereupon the shaft 20 is cammed upwardly to provide for release of the container and removal of the container from the turntable 10. The profile cams 84 are supported from a fixedly mounted top plate member 85. A socket member 86 is fixedly fastened to plate 85 by means of a machine bolt 86. A tubular shaft 87 has its upper end journaled for rotation in socket 86 and its lower end 88 is coupled to driving mechanism, not shown. The tubular shaft is keyed to the turntable 10 for driving it. It is also keyed to the plurality of arms 89 that support the camming mechanism for cap tightening device shaft 20. The mechanism for supporting the cam device so it rotates in synchronism with the turntable 10 and the arms 89 is clamped to tubular shaft 47 by way of previously mentioned annulus 49.

FIG. 7 illustrates two of the plurality of the cap tightening devices 9, one of which is positioned over a container 12 and is retracted out of engagement with the container cap. The capping device 9 that has moved from where the right hand device is positioned in FIG. 7 to where the left hand device is positioned in FIG. 7 is now in frictional driving relationship with the curved frictional surface 41.

In FIGS. 1 and 3 the curved frictional surface 41 that engages the knurled surface 11 of the capping device 9 housing is presented convexly to surface 11 in the FIG. 1 embodiment. FIG. 8 demonstrates that instead of having the radially outwardly convex surface 41 do the rotational driving of the cap tightening device 91 the curved support 42 can also be mounted radially outwardly from the capping devices 9 such that its friction imparting surface 41 is concave and concentric to the turntable 10 axis for engaging the knurled housing 32,33 of the capping devices. It will be recognized by those skilled in the art that the peripheral driven surface 11 of the housing could be provided with an abrasive coating or other coating for developing an adequate frictional force. The surface 41 of the curved driving member may also be provided with high frictional properties in various ways.

Attention is invited now to the modified FIGS. 9 and 10 embodiment wherein the new cap tightening device is driven rotationally to perform a cap tightening operation on a container with a gear and gear segment arrangement rather than a friction drive. The device in FIG. 9 is basically the same as in the previously discussed embodiment except that the largest diameter housing section 33 is provided with a ring gear 100 that is concentric to the axis of non-rotating but vertically reciprocable shaft 20. The ring gear may be variously fastened to the housing or it may machined or hobbed on the housing section 33 so it is unitary therewith. The ring gear 100 may also be made part of the upper section 32 of the housing of the cap tightener 9.

As shown in FIGS. 9 and 10, There is a stationarily mounted gear segment 101 that is positioned adjacent the circular orbital path of the devices 9 with the ring gear thereon such that some time after each container is deposited on a container support 81 the ring gear 100 will run onto and mesh with the stationary gear segment 101. Since the cap tightening device 9 and the container 12 are orbiting, the housing 32, 33 turns to cause the cap on the container engaged by the adapter 76 to be tightened on the neck of the container. Only part of the adjustable support 102 for the gear segment 101 is shown since a skilled mechanic would be able to devise a suitable support without the need for being supplied with design details. As in the case of the friction drive embodiment, the stationary driving element 101, namely the gear segment, can be positioned inside of the circular translational path of the gears 100 or outside.

We claim:

1. A device for turning threaded caps onto threaded containers to tighten the caps on the containers that are translating with the devices, comprising:

a plurality of non-rotating shafts adapted for reciprocating axially between upper and lower positions periodically as the shafts translate transversely of the axial movement in phase with respective containers, a first member mounted for rotating on each shaft and constrained against moving axially of the shaft, a generally cylindrical housing axially adjustably mounted to each first member concentric to the axis of the shaft, said housing defining an annular interior chamber that is concentric to the shaft, a hollow magnetizable container cap driving spool mounted to the shaft for rotating on the shaft within said annular chamber and constrained against moving axially relative to the shaft, a plurality of axially extending magnets arranged generally in a circle surrounding the spool and magnetically coupled to the spool, and a hysteresis ring being composed of a material that has low magnetic reluctance arranged concentric to the magnets within said chamber, a stationary element positioned along the path in which said containers translate for engaging and turning the housing after said spool has been lowered by lowering the shaft and the spool is coupled to a cap, thereby causing the cap to be turned onto the container with a degree of tightness limited by the mutual magnetic attractive force between the ring, the magnets and the spool.

2. A device according to claim 1 wherein said first member has a cylindrical periphery and a part of the housing that is adjustably mounted to said first member is circular to provide for the housing being turned within limits on said first member about the axis of the shaft, and an axially extending helical groove in said periphery of the first member and a detent element on said housing cooperating with the helical groove to provide for adjusting the housing axially of said first member to fix the hysteresis ring in a selected axial position relative to the magnets to thereby control the torsional force that the device can apply to a cap.

3. A device according to claim 1 wherein said housing is movable axially relative to the first member to provide for adjusting the axial position of the hysteresis ring in said housing relative to the magnets to control the strength of the magnetic coupling between the hysteresis ring and the magnets, and a member operative to selectively clamp and release the housing for positional adjustment relative to the first member.

4. A cap tightening device according to any one of claims 1, 2 or 3 including apparatus for transporting said devices along a predetermined path while said spools of the devices are coupled to containers.

5. A combination according to claim 1 wherein said stationary element adjacent said path that engages the housing has a friction enhancing surface for engaging the housing when the device translates to the surface.

6. A combination according to claim 4 including a ring gear mounted to the respective housings, concentric to said shaft, wherein said member positioned adjacent said path is a member having an array of gear teeth arranged along the path such that said ring gear becomes meshed with said teeth to rotate said housing in response to said devices being transported.

7. A combination according to claim 5 wherein said friction enhancing surface is a knurled surface.

8. A plurality of devices according to any one of claims 1, 2 or 3 in combination with a turntable for turning rotationally about a vertical axis, the turntable having a plurality of container supports arranged in a circle concentric to the vertical axis for transporting said containers along a circular path, each of said container supports having mounted above it one of said devices and all of the devices are transported in synchronism and in equal angles of rotation with the respective container supports, cam means operative to maintain the shaft means and the device thereon in an upper position while said turntable turns through a first angle of rotation and to lower said shaft to a lower position for said device to engage the cap on the container, while the turntable turns through a second angle of rotation.

9. Apparatus according to claim 8 wherein said device driving member has a curved surface that is concentric to the rotational axis of the turntable and said housing of the device has a cylindrical surface concentric to the axis of the shaft to provide for said cylindrical surface to be frictionally engaged with the curved surface for driving said housing rotationally while the turntable is rotating through the second angle of rotation.

10. Apparatus according to claim 8 wherein said device driving member is a gear segment disposed concentrically to the axis of the turntable and the housing of the device is provided with a ring gear that is concentric to the shaft to provide for the ring gear to mesh with the gear segment for driving said housing rotationally while the turntable is rotating through the second angle of rotation.

11. The apparatus according to claim 9 wherein the cylindrical surface of the housing is knurled.

12. A device for turning threaded caps onto threaded containers to tighten the caps on the containers that are translating with the devices, comprising:

a plurality of non-rotating shafts adapted for reciprocating axially between upper and lower positions periodically as the shafts translate transversely of the axial movement in phase with respective containers, a first member mounted for rotating on each shaft and constrained against moving axially of the shaft, a generally cylindrical housing axially adjustably mounted to each first member concentric to the axis of the shaft, said housing defining an annular interior chamber that is concentric to the shaft, a hollow magnetizable container cap-driving spool mounted to the shaft for rotating on the shaft within said annular chamber and constrained against moving axially relative to the shaft, a plurality of axially extending magnets arranged generally in a circle surrounding the spool and magnetically coupled to the spool, and a hysteresis ring composed of a material that has low magnetic reluctance arranged concentric to the magnets within said chamber, a ring gear fastened to the housing concentrically to the shaft, a toothed member positioned along the path in which said containers translate such that when the shafts are in said lower position for said spools to become coupled with caps and said devices are translating, the respective ring gears engage said toothed member in succession to turn said housing and said spool to effect tightening the caps.

* * * * *